US008256496B2

(12) United States Patent
Shuttleworth et al.

(10) Patent No.: US 8,256,496 B2
(45) Date of Patent: Sep. 4, 2012

(54) AIR DIVERTER FOR VEHICLE COOLING SYSTEM

(75) Inventors: Adam Joe Shuttleworth, Denver, IA (US); Matthew Robert Oliver, Waterloo, IA (US); Ronnie Franklin Burk, Cedar Falls, IA (US); Dick J. Goering, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 1112 days.

(21) Appl. No.: 11/951,903

(22) Filed: Dec. 6, 2007

(65) Prior Publication Data

US 2009/0145577 A1 Jun. 11, 2009

(51) Int. Cl.

| | |
|---|---|
| ***B60H 1/00*** | (2006.01) |
| ***F28D 7/10*** | (2006.01) |
| ***F02B 29/04*** | (2006.01) |
| ***F02B 33/00*** | (2006.01) |
| ***F01P 1/06*** | (2006.01) |
| ***F01P 11/08*** | (2006.01) |

(52) U.S. Cl. ..... 165/41; 165/140; 60/599; 123/41.31; 123/41.33; 123/563

(58) Field of Classification Search ..... 165/41, 165/42, 43, 297, 47, 140, 103; 180/68.1, 180/68.4; 123/41.04, 41.31, 41.33, 41.62, 123/41.63, 41.58, 41.51, 563; 60/599
See application file for complete search history.

(56) References Cited

U.S. PATENT DOCUMENTS

| | | | | |
|---|---|---|---|---|
| 2,784,571 | A * | 3/1957 | Schelp | 62/92 |
| 4,317,439 | A * | 3/1982 | Emmerling | 123/563 |
| 4,690,204 | A * | 9/1987 | Reichel et al. | 165/44 |
| 4,767,425 | A * | 8/1988 | Camplin et al. | 55/306 |
| 5,219,016 | A * | 6/1993 | Bolton et al. | 165/41 |
| 5,316,079 | A * | 5/1994 | Hedeen | 165/140 |
| 5,427,502 | A | 6/1995 | Hudson | |
| 5,927,399 | A * | 7/1999 | Kazakis et al. | 165/284 |
| 6,167,956 | B1 * | 1/2001 | Bostedo et al. | 165/284 |
| 6,192,838 | B1 * | 2/2001 | Matsuo et al. | 123/41.01 |
| 6,302,228 | B1 * | 10/2001 | Cottereau et al. | 180/68.1 |
| 6,523,520 | B1 * | 2/2003 | Chatterjea | 123/198 E |
| 6,817,404 | B2 | 11/2004 | Frana-Guthrie et al. | |

(Continued)

FOREIGN PATENT DOCUMENTS

| | | |
|---|---|---|
| DE | 19849619 | 5/2000 |

(Continued)

OTHER PUBLICATIONS

European Search Report, (5 pages).

*Primary Examiner* — Allen Flanigan
*Assistant Examiner* — Jason Thompson

(57) ABSTRACT

The invention relates to an air diverter for a vehicle cooling system. There is a need for an improved vehicle cooling system. An air diverter is provided for a vehicle cooling system having a radiator, a fan for moving air through the radiator and a cooling unit positioned in front of the radiator with respect to air moving through the radiator. The fan is surrounded by a fan shroud. The air diverter includes a collector and a conduit. The collector is positioned between the cooling unit and the radiator. The collector receives a portion of air which passes through the cooling unit. The conduit extends around an edge of the radiator and communicates air from the collector to the interior of the fan shroud while bypassing the radiator.

11 Claims, 5 Drawing Sheets

U.S. PATENT DOCUMENTS

| | | | | |
|---|---|---|---|---|
| 7,464,700 | B2 * | 12/2008 | Kolb | 123/563 |
| 7,481,287 | B2 * | 1/2009 | Madson et al. | 180/68.1 |
| 2006/0000595 | A1 * | 1/2006 | Kang et al. | 165/203 |
| 2008/0041556 | A1 * | 2/2008 | Braun et al. | 165/41 |
| 2008/0142285 | A1 * | 6/2008 | McCurdy et al. | 180/68.1 |
| 2010/0071407 | A1 * | 3/2010 | Taras et al. | 62/507 |

FOREIGN PATENT DOCUMENTS

| | | |
|---|---|---|
| DE | 102004034313 | 2/2006 |

* cited by examiner

AIR DIVERTER FOR VEHICLE COOLING SYSTEM

FIELD OF THE INVENTION

The present invention relates to a vehicle cooling system, and more particularly to a cooling system with an air diverter.

BACKGROUND OF THE INVENTION

Vehicle cooling systems are known wherein a separate cooling unit is mounted in front of the radiator. For example, a four wheel drive tractors included an air-to-air charge air cooler which was mounted in front of the radiator. Such an arrangement is also shown in U.S. Pat. No. 5,316,079 issued to Hedeen on 31 May 1994. In such an arrangement the air flowing out of the upstream cooler can be heated to a temperature which is hotter than the coolant in the downstream radiator, and this can degrade the cooling function of the downstream radiator.

SUMMARY OF THE INVENTION

Accordingly, an object of this invention is to improve the operation of a cooling system which has a separate cooling unit mounted in front of the radiator.

This and other objects are achieved by the present invention, wherein an air diverter is provided for a vehicle cooling system having a radiator, a fan for moving air through the radiator, a fan shroud surrounding the fan, and a cooling unit, such as a charge air cooler, positioned in front of the radiator with respect to air moving through the radiator. The air diverter includes a collector and a conduit. The collector is positioned between the cooler and the radiator and adjacent to a downstream side of the cooling unit. The collector forms a chamber which receives air which passes through at least a portion of the cooling unit. The conduit communicates air from the chamber to an interior of the fan shroud so that air flows from the chamber to the fan and bypasses the radiator. This reduces the heat transfer to the radiator coolant and allows the radiator to reject more heat with the same fan shaft power, and the same radiator top tank. This provides an increase in heat rejection capability at a low cost per tractor. This has the potential to allow for a power increase with only minimal changes to the cooling package of the tractor.

DESCRIPTION OF THE PREFERRED EMBODIMENT

Figure 1:
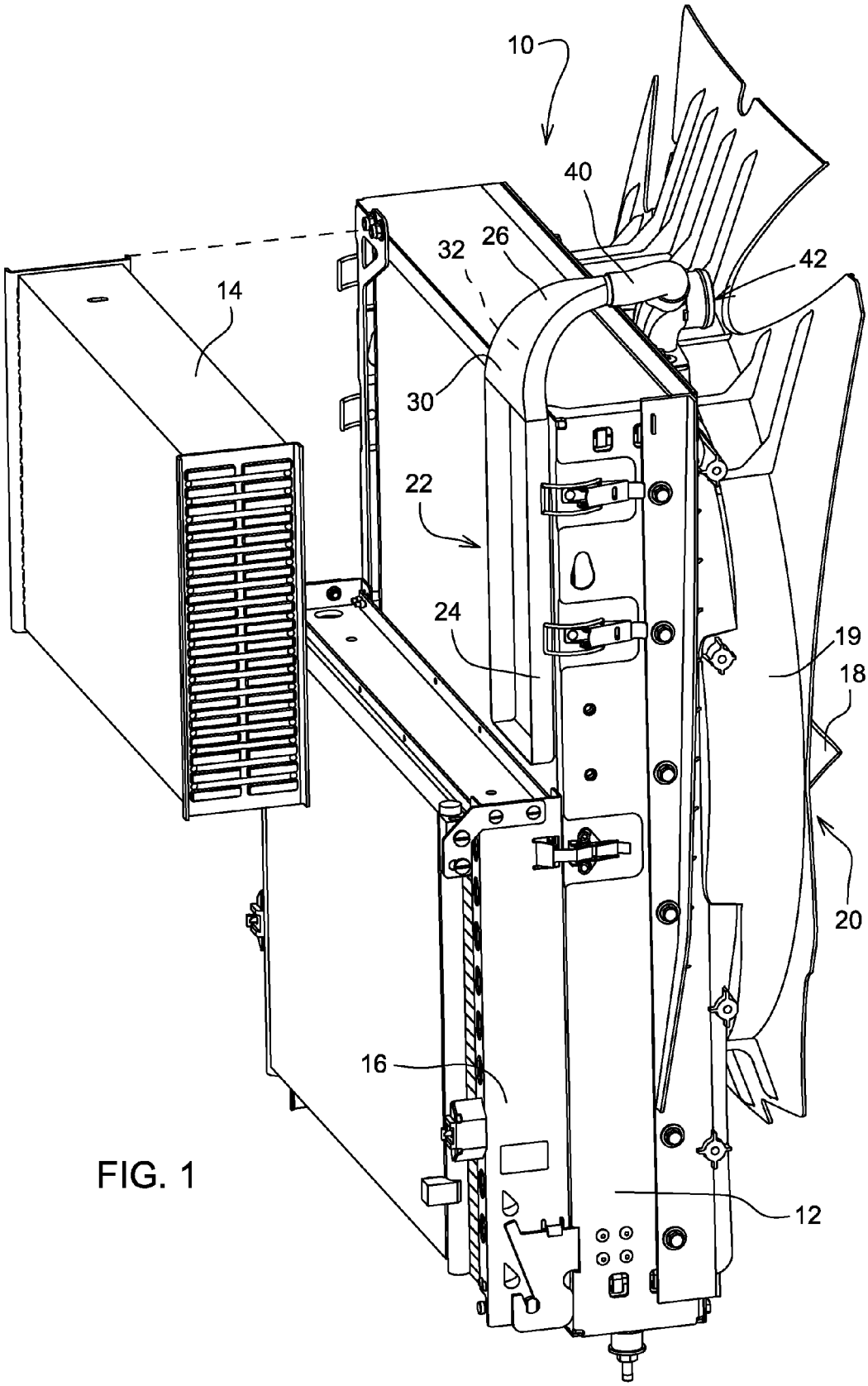
FIG. 1 is a partially exploded perspective assembly view of a vehicle cooling system embodying the invention.
Figure 2:
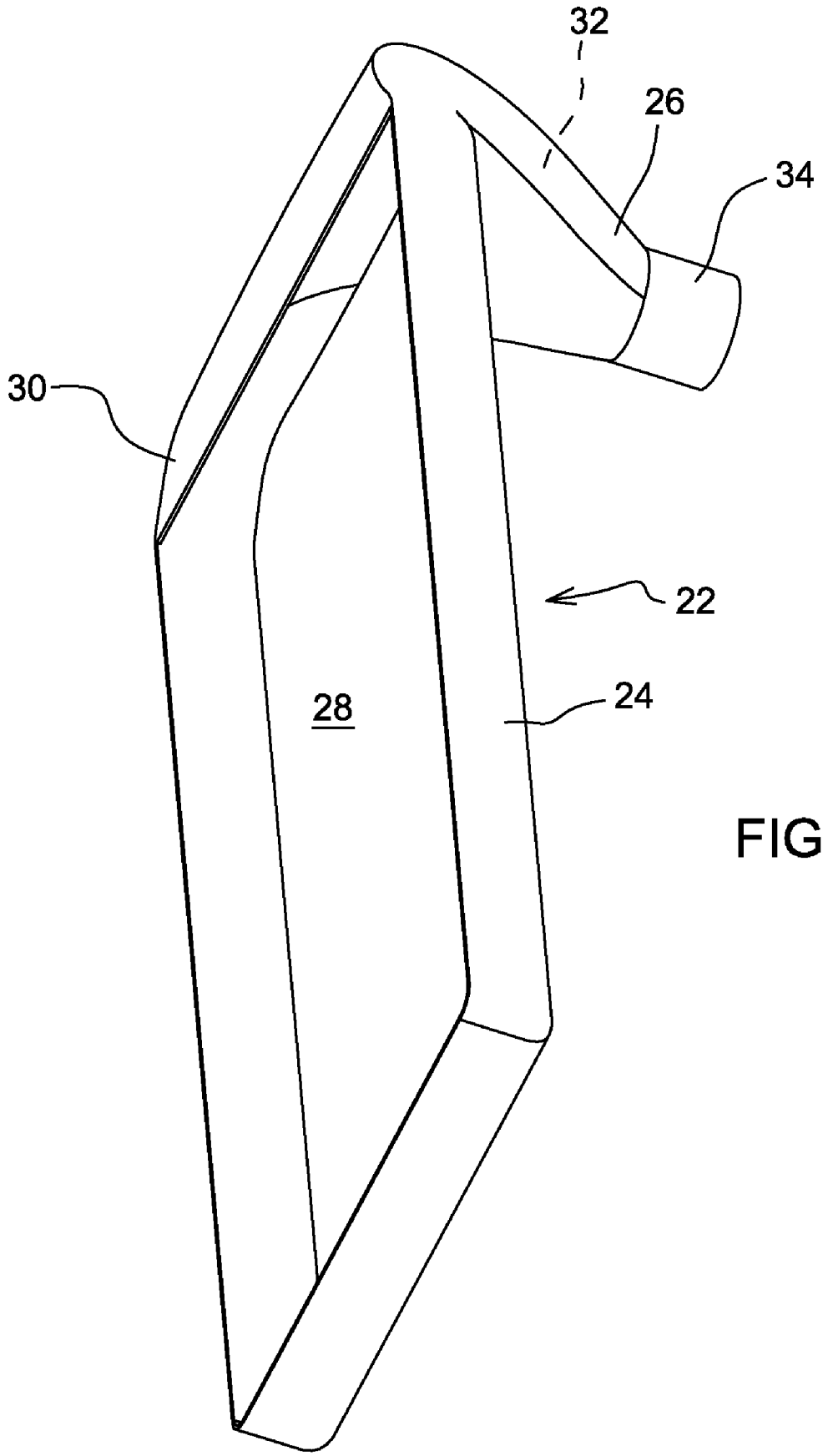
FIG. 2 is a perspective view of the air diverter of FIG. 1.
Figure 5:
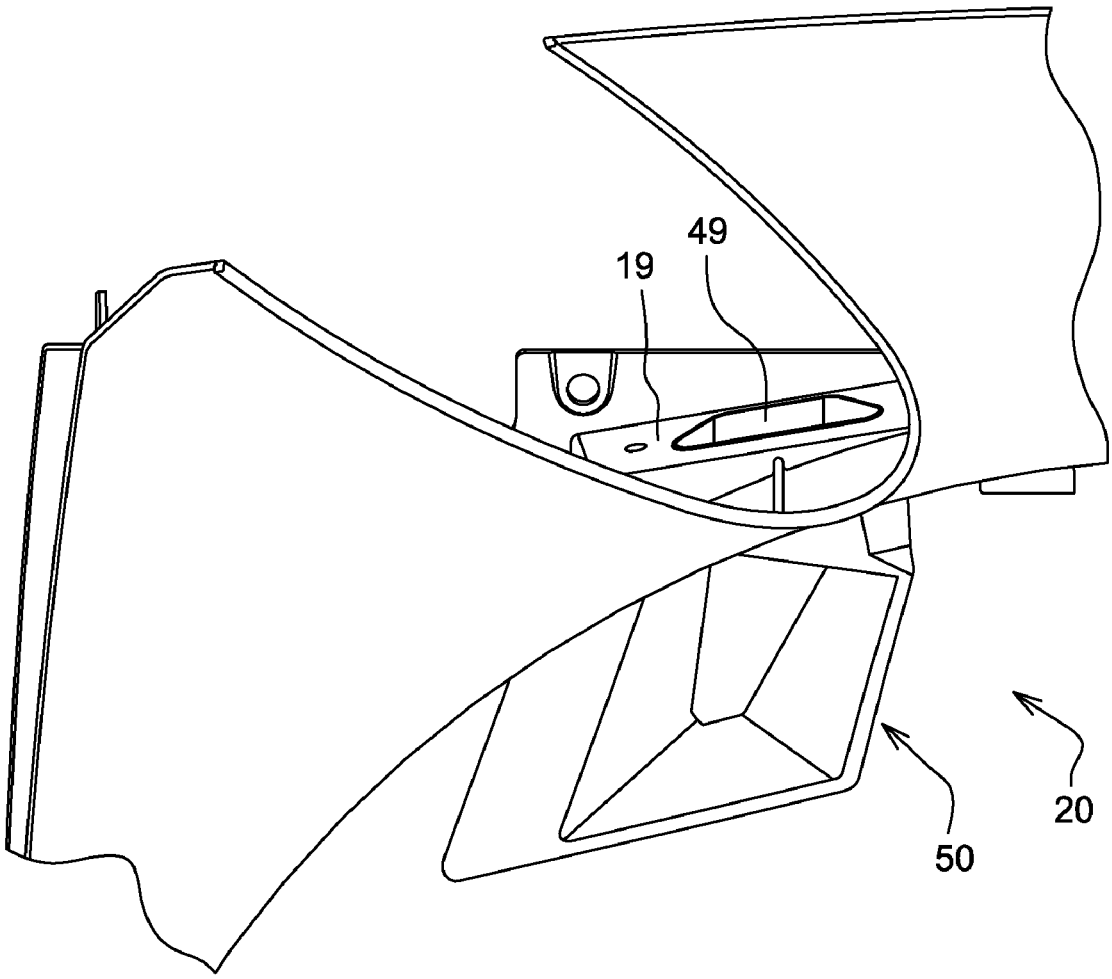
FIG. 5 is a perspective end view of portion of the fan shroud of FIG. 1.

With reference to FIG. 1, a vehicle cooling system 10 includes a radiator 12, cooling units such as a charge air cooler 14 and an oil cooler 16, and a fan 18 surrounded by a fan shroud 20. The fan 18 pulls air from left to right viewing FIG. 1, through the coolers 14 and 16 and then through the radiator 12. Referring also to FIG. 5, the fan shroud 20 has an outer wall 19. Wall 19 includes an aspirator opening 49 and is attached a conventional aspirator 50. The charge air cooler 14 and the radiator 12 are dimensioned and positioned so that substantially all the air passing through the charge air cooler 14 will impinge upon the upstream side of the radiator 12. This because the charge air cooler 14 has side walls that are aligned with the side walls of the radiator 12, and the charge air cooler 14 has a top wall that which is aligned with a top wall of the radiator 12.

The cooling system 10 also includes an air diverter 22 that is attached to the cooler (14) and is non-movable relative to the cooler (14) and the radiator (12), best seen in FIG. 1 The collector 24 is positioned between the downstream side of the cooler 14 and the upstream side of the radiator 12. The collector 24 also overlaps a portion of the upstream side of the radiator. The collector 24 is adjacent to the upstream side of the radiator, is attached to a downstream side of the cooler 14 and encloses a chamber 28 which is open towards the cooler 14 and which receives air which passes through at least a portion of the cooler 14. The conduit 26 has a first end 30 connected to the collector 24. The conduit 26 encloses a passage 32 which is communicated with the chamber 28. The conduit 26 has a second end 34. A flexible hose 40 connects the second end of the conduit 26 to a connector 42 which is mounted on the fan shroud wall 19 over the aspirator opening 49. The conduit 26 extends across a top end of the radiator 12. As a result, the air diverter 22 wraps around an upper corner of the radiator 12.

Figure 3:
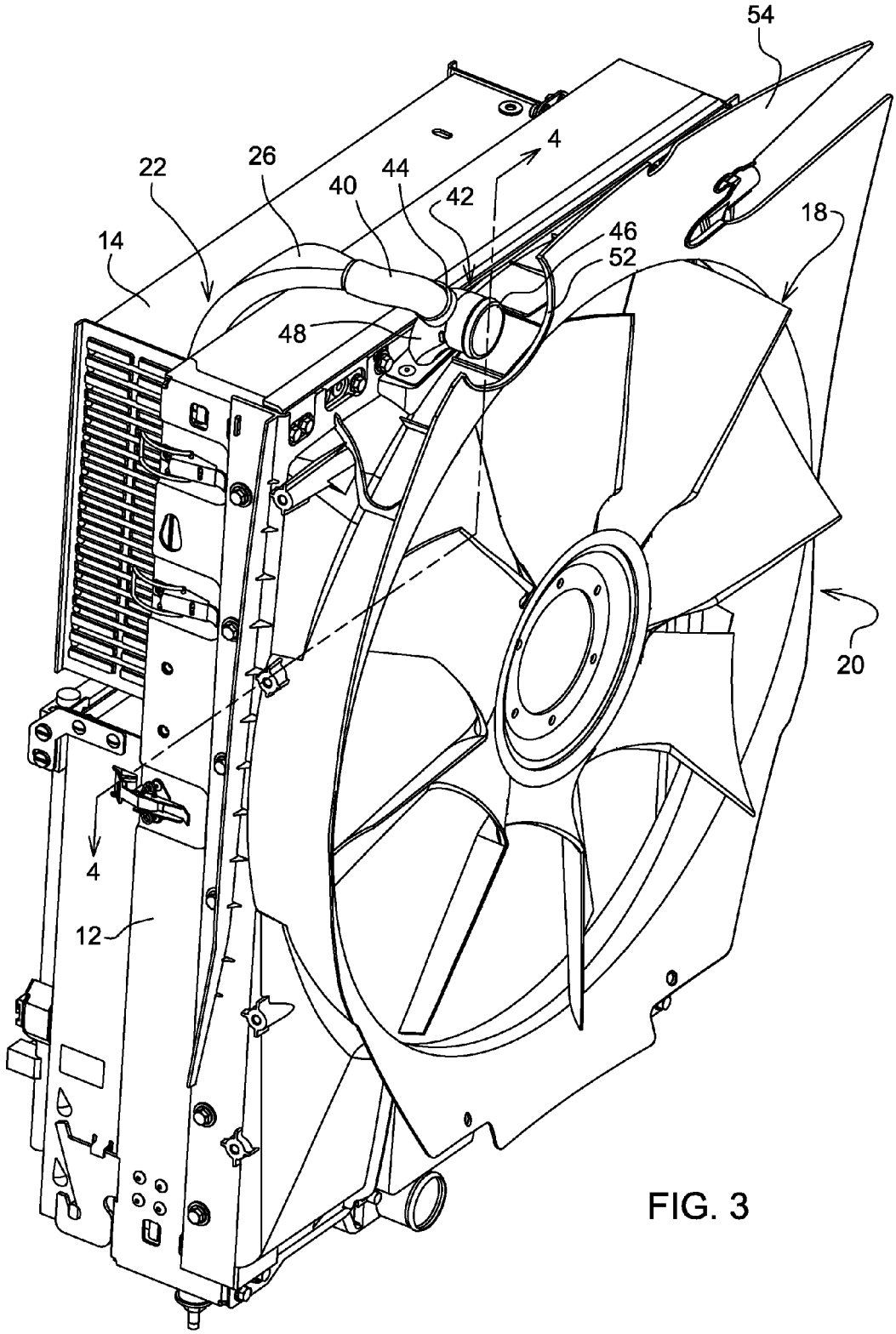
FIG. 3 is a rear perspective view of the cooling system of FIG. 1.
Figure 4:
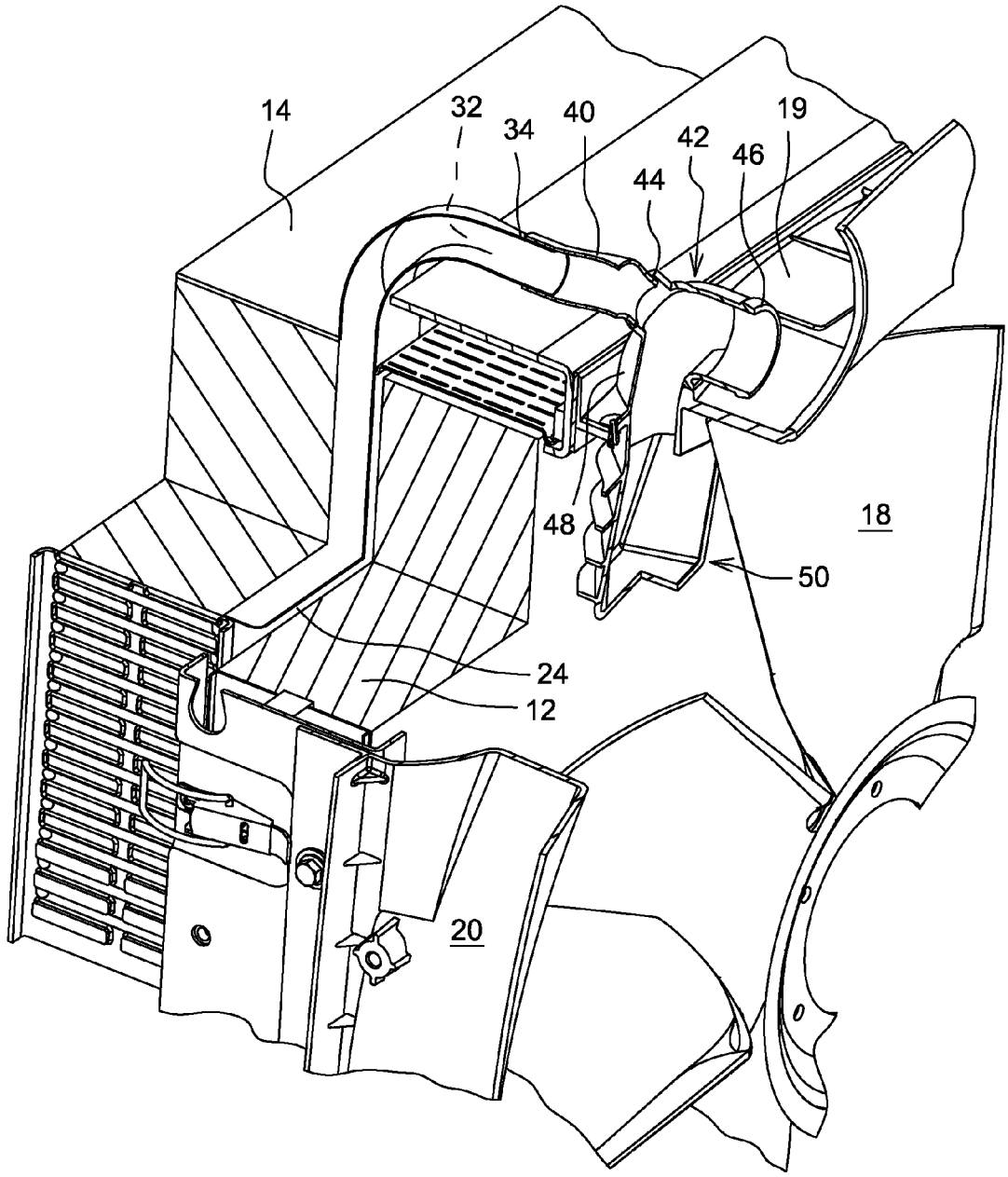
FIG. 4 is a partially sectional perspective detailed view of a portion of FIG. 3.

As best seen in FIGS. 3 and 4, the connector 42 includes a hollow body which forms an upwardly opening inlet port 44, an axially extending rearward opening inlet port 46 and a downward opening outlet port 48. Port 48 is attached to a shroud wall 19 and is communicated with aspirator inlet 49. Port 46 is preferably connected by a hose (not shown) to a conventional air cleaner box (not shown) to aspirate the air cleaner box. As the blades of fan 18 rotate past the aspirator 50, air is pulled from diverter collector 24 through conduit 26, hose 40 and aspirator 50 and into the interior of shroud 20. The conduit 26 is curved so that the conduit and the hose 40 extend around an upper edge of the radiator 12. As a result, the diverter 22 communicates air from the downstream end of cooler 14, around, but not through radiator 12, to the interior of the fan shroud 20, so that at least a portion of the air which flows through the cooler 14 bypasses the radiator 12.

Thus, the diverter 22 diverts the hot cooling air from behind the charge air cooler 14 to behind the radiator 12 so that the hot air does not pass through the radiator 12. The air diverter 22 is aspirated by the cooling air fan 18 and shroud 20 to maintain the flow of cooling air through the charge air cooler 14 in the area of the diverter 22.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. In a vehicle cooling system having a radiator, a fan for moving air through the radiator, a fan shroud surrounding the fan, and a cooling unit positioned in front of the radiator with respect to air moving through the radiator, the improvement comprising:

non-movable air diverter, the diverter comprising a collector and a conduit, the collector always covering only a portion of an upstream side of the radiator, the collector being positioned between a downstream side of the cooling unit and an upstream side of the radiator and adjacent to a downstream side of the cooling unit and enclosing a chamber which receives air which passes through a portion of the cooling unit, and the conduit communicating air from the chamber to an interior of the fan shroud so that a portion of the air which flows through the cooling unit always bypasses the radiator.

2. The vehicle cooling system of claim 1, wherein:

the cooling unit comprises a charge air cooler.

3. The vehicle cooling system of claim 1, wherein:

an aspirator is attached to the fan shroud; and the conduit communicates air from the chamber to an inlet of the aspirator.

4. The vehicle cooling system of claim 3, further comprising:

a connector mounted to the fan shroud, the connector having an outlet communicated with the aspirator inlet, an inlet communicated with the diverter conduit.

5. The vehicle cooling system of claim 4, wherein:

the connector includes a further inlet.

6. The vehicle cooling system of claim 1, wherein:

the conduit is curved and extends around an edge of the radiator.

7. A vehicle cooling system comprising:

a radiator;

a fan shroud having an outer wall and an opening in the outer wall;

a fan for moving air through the radiator and surrounded by the fan shroud outer wall;

a cooling unit positioned in front of the radiator with respect to air moving through the radiator; and a non-movable air diverter, the diverter comprising a collector and a conduit, the collector always covering a portion of an upstream side of the radiator, the collector being positioned between a downstream side of the cooling unit and the upstream side of the radiator and forming a chamber which receives air which passes through a portion of the cooling unit, and the conduit communicating air from the chamber to the fan shroud opening so that only a portion of the air which flows through the cooling unit always bypasses the radiator.

8. An air diverter for a vehicle cooling system having a radiator, a fan for moving air through the radiator and a cooling unit positioned in front of the radiator with respect to air moving through the radiator, the air diverter comprising:

a collector positioned between the cooling unit and the radiator, the collector always covering only a portion of an upstream side of the radiator, the collector always receiving only a portion of air which passes through the cooling unit; and a conduit which communicates air from the collector to the fan while bypassing the radiator, the diverter wrapping around a corner of the radiator.

9. The air diverter of claim 8, wherein:

the fan is surrounded by an outer wall of a fan shroud; and the conduit comprises a first end connected to the collector and a second end connected to an opening in the outer wall of the fan shroud, the conduit forming a bend which extends around an edge of the radiator.

10. In a vehicle cooling system having a radiator, a fan for moving air through the radiator, a fan shroud surrounding the fan, and a cooling unit positioned in front of the radiator with respect to air moving through the radiator, the cooling unit having side walls which are aligned with side walls of the radiator, and the cooling unit having a top wall which is aligned with a top wall of the radiator, the improvement comprising:

an air diverter, the diverter comprising a non-movable collector and a conduit, the collector being positioned between the cooling unit and always overlapping only a portion of an upstream side the radiator and enclosing a chamber which receives air which passes through at least a portion of the cooling unit, and the conduit communicating air from the chamber to an interior of the fan shroud so that only a portion of the air which flows through the cooling unit always bypasses the radiator.

11. In a vehicle cooling system having a radiator, a fan for moving air through the radiator, a fan shroud surrounding the fan, and a cooling unit positioned in front of the radiator with respect to air moving through the radiator, the improvement comprising:

non-movable air diverter, the diverter comprising a collector and a conduit, the collector being positioned between the cooling unit and the radiator and adjacent to an upstream side of the radiator and enclosing a chamber which receives air which passes through at least a portion of the cooling unit, the collector always covering only a portion of the upstream side of the radiator, and the conduit communicating air from the chamber to an interior of the fan shroud so that only a portion of the air which flows through the cooling unit always bypasses the radiator.

* * * * *